US009044869B2

(12) United States Patent
Xing et al.

(10) Patent No.: US 9,044,869 B2
(45) Date of Patent: Jun. 2, 2015

(54) ELECTRIC CIRCULAR SAW

(71) Applicant: Chervon (HK) Limited, Wanchai (HK)

(72) Inventors: Li Xing, Nanjing (CN); Yibao Zhang, Nanjing (CN); Honggui Shuai, Nanjing (CN); Xin Yang, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 296 days.

(21) Appl. No.: 13/759,230

(22) Filed: Feb. 5, 2013

(65) Prior Publication Data

US 2013/0199049 A1 Aug. 8, 2013

(30) Foreign Application Priority Data

Feb. 6, 2012 (CN) ..... 2012 1 0025175
Jan. 30, 2013 (CN) ..... 2013 1 0034419

(51) Int. Cl.

| | |
|---|---|
| ***B26B 25/00*** | (2006.01) |
| ***B27B 9/00*** | (2006.01) |
| ***B27G 19/04*** | (2006.01) |
| ***B25F 5/02*** | (2006.01) |

(52) U.S. Cl.

CPC . *B26B 25/00* (2013.01); *B27B 9/00* (2013.01); *B27G 19/04* (2013.01); *B25F 5/02* (2013.01)

(58) Field of Classification Search

CPC ..... B26B 25/00; B25F 5/02; B27G 19/04; B27B 9/00; B27B 9/02

USPC ..... 30/1, 123, 373–377, 390–391, 505

See application file for complete search history.

(56) References Cited

U.S. PATENT DOCUMENTS

| | | | | | |
|---|---|---|---|---|---|
| 1,792,204 | A * | 2/1931 | Wallace et al. | ..... | 30/376 |
| 2,722,246 | A * | 11/1955 | Arnoldy | ..... | 30/391 |
| 3,735,489 | A * | 5/1973 | Zatorsky, Jr. | ..... | 30/390 |
| 4,081,906 | A * | 4/1978 | Sigler | ..... | 30/276 |
| 4,774,866 | A * | 10/1988 | Dehari et al. | ..... | 83/478 |
| 4,892,022 | A * | 1/1990 | Cotton et al. | ..... | 83/478 |
| 4,971,122 | A * | 11/1990 | Sato et al. | ..... | 144/136.95 |
| 2002/0133955 | A1* | 9/2002 | Kani | ..... | 30/391 |
| 2002/0157265 | A1* | 10/2002 | Haneda et al. | ..... | 30/391 |
| 2003/0136011 | A1* | 7/2003 | Refson | ..... | 30/391 |
| 2005/0028375 | A1* | 2/2005 | Stones et al. | ..... | 30/134 |
| 2005/0217124 | A1* | 10/2005 | Fuchs et al. | ..... | 30/377 |
| 2006/0037445 | A1* | 2/2006 | Sergyeyenko et al. | ..... | 83/13 |
| 2007/0022852 | A1* | 2/2007 | Tracy et al. | ..... | 83/13 |
| 2007/0093189 | A1* | 4/2007 | Gaul et al. | ..... | 451/451 |
| 2008/0078090 | A1* | 4/2008 | Johnson, III | ..... | 30/391 |
| 2008/0115371 | A1* | 5/2008 | Allen et al. | ..... | 30/517 |
| 2008/0244910 | A1* | 10/2008 | Patel | ..... | 30/123 |
| 2009/0064510 | A1* | 3/2009 | Niwa et al. | ..... | 30/390 |
| 2010/0146797 | A1* | 6/2010 | Dreher | ..... | 30/228 |
| 2011/0162218 | A1* | 7/2011 | Roise et al. | ..... | 30/377 |
| 2013/0081284 | A1* | 4/2013 | Moreno | ..... | 30/374 |
| 2013/0081285 | A1* | 4/2013 | Moreno | ..... | 30/377 |

* cited by examiner

*Primary Examiner* — Sean Michalski
(74) *Attorney, Agent, or Firm* — Greenberg Traurig, LLP

(57) ABSTRACT

An electric circular saw includes a housing, a switch trigger arranged on the housing, a switch controlling rod for limiting the travel range of the switch trigger, a base plate, a depth support arranged on the base plate and a connecting rod for limiting the travel range of the depth support. The electric circular saw further includes an movable control member having a driving portion for driving the first connecting rod and a limiting portion for limiting the switch controlling rod, and the moving distance from the driving portion to a contact surface between the driving portion and the first connecting rod is larger than or equal to the moving distance from the limiting portion to a contact surface between the limiting portion and the switch controlling rod.

20 Claims, 9 Drawing Sheets

ELECTRIC CIRCULAR SAW

CROSS REFERENCE TO RELATED APPLICATION

This application is a non-provisional application claiming priority from Chinese Patent Application Serial No. 201210025175.9, filed Feb. 6, 2012, and Chinese Patent Application Serial No. 201310034419.4, filed Jan. 30, 2013, each of which are incorporated herein by reference in their entirety.

FIELD OF THE DISCLOSURE

The present description relates generally to electric circular saws, and more particularly to an electric circular saw with a switch protection mechanism.

BACKGROUND OF RELATED ART

A commonly used electric circular saw has a saw blade which is rotatable at high speed and a switch trigger for activating a motor. In the non-operation state, if the saw blade is exposed, an accidental operation for the switch trigger will cause a serious safety accident. Generally, the saw blade of the electric circular saw is provided with a movable shield. In the operation state, as the electric circular saw moves relative to the workpiece, the movable shield enables the saw blade to be exposed so as to cut the workpiece; in the non-operation state, the movable shield covers the saw blade under the action of the biasing of an elastic member, thereby avoiding the safety risk caused by the accidental operation. However, there is also a problem: in the non-operation state, as the electric circular saw moves relative to the workpiece, the exposure of the saw blade may cause damage to the surface of the workpiece and affect the appearance of the workpiece.

Additionally, the movable shield cannot provide a safety protection if the operator needs to exchange the saw blade of the electric circular saw, thus it is necessary to provide a switch protection mechanism to the switch trigger, thereby avoiding the safety accident caused by the start-up of the motor due to the accidental operation. Generally, a micro switch is attached in series to a main switch of the electric circular saw, and the on-off of the main switch may be controlled by the on-off of the micro switch, thereby preventing the main switch from being triggered by the accidental operation. But, there is still a problem: if the micro switch is shorted and then the safety protection thereof is ineffective, when the people is unaware and operates it normally, a safety accident would occur.

SUMMARY

The technical problem to be solved by the present invention is to provide an electric circular saw with a switch protection mechanism, which can prevent the switch trigger being triggered by the accidental operation in the normal operation or in the operation of exchanging the saw blade.

In order to resolve the above problem, the present invention provides An electric circular saw, comprising: a housing; a switch trigger arranged on the housing; a switch controlling rod for limiting the travel range of the switch trigger, wherein the switch controlling rod is pivotally mounted to the inner wall of the housing through a pin shaft, a stopping member for limiting the travel range of the switch trigger is arranged between the switch controlling rod and the switch trigger, and the rotation of the switch controlling rod forces the stopping member to get out of the travel range of the switch trigger so as to control the operation of the switch trigger, the switch controlling rod further comprises an elastic member for causing the switch controlling rod to force the stopping member to restore towards the switch trigger, and the switch controlling rod is more connected with a pushing button protruding out from the housing in a normal state; a base plate; a depth support arranged on the base plate; a first connecting rod for limiting the travel range of the depth support; a rotary plate arranged in the housing, and the rotary plate comprising a first convex portion protruding outwards from a side of the rotary plate for driving the first connecting rod, and a second convex portion protruding outwards from the side of the rotary plate in the front of the first convex portion in a first direction for limiting the switch controlling rod, and the moving distance between the first convex portion and the first connecting rod being larger than or equal to that between the second portion and the switch controlling rod.

As an improvement, the electric circular saw further comprising a rotating button protrudes out from the housing in a normal state, the rotary plate is connected with the rotating button.

According to one embodiment, the stopping member is a convex portion extending from the switch controlling rod towards the switch trigger.

As an improvement, the electric circular saw further comprises a saw blade, the base plate is pivotally connected to the housing and defines a saw gap adapted for the saw blade to pass through, the switch controlling rod comprises a blocking portion which is capable of contacting the depth support, and when a pivoting point between the base plate and the housing is considered as a circle center, the arc angle from the blocking portion to a contact surface of the depth support is smaller than that from the lower end of the saw blade to the saw gap.

According to one embodiment, the blocking portion is a convex portion extending from the switch controlling rod towards the depth support.

According to one embodiment, the depth support defines a sliding groove therein, and the first connecting rod is pivotally mounted to the inner wall of the housing through a pin shaft and has a stopping portion which may be accommodated into the sliding groove so as to limit the travel range of the depth support and an elastic member for driving the first connecting rod to rotate in an engaged direction of the stopping portion and the sliding groove.

According to one embodiment, the electric circular saw further comprises a second connecting rod, the rotary plate defines a groove opening therein and comprises a first flange formed adjacent to the groove opening, the second connecting rod is pivotally mounted to the inner wall of the housing through a pin shaft and having a hook portion for mating with the groove opening at one end and a second flange at the other end, and the second connecting rod is more connected with an elastic member for driving the second connecting rod to rotate towards the rotary plate; wherein in the normal state, the hook portion of the second connecting rod contacts the first flange; when the rotary plate is rotated in the first direction, the hook portion of the second connecting rod is mated with the groove opening; and when the housing and the base plate are pressed oppositely, the depth support presses the second flange and forces the second connecting rod to rotate in a disengaged direction of the hook portion and the groove opening.

As an improvement, the rotary plate is further connected with an elastic member for driving the rotary plate to rotate in a second direction opposite to the first direction.

Furthermore, the present invention provides an electric circular saw, comprising: a housing; a switch trigger arranged on the housing; a switch controlling rod for limiting the travel range of the switch trigger; a base plate; a depth support arranged on the base plate; a first connecting rod for limiting the travel range of the depth support; an operational control member arranged in the housing, and the control member comprising a driving portion for driving the first connecting rod and a limiting portion for limiting the switch controlling rod, and the moving distance between the driving portion and the first connecting rod being larger than or equal to that between the limiting portion and the switch controlling rod.

According to one embodiment, the switch controlling rod is pivotally mounted to the inner wall of the housing through a pin shaft, a stopping member for limiting the travel range of the switch trigger is arranged between the switch controlling rod and the switch trigger, and the rotation of the switch controlling rod forces the stopping member to get out of the travel range of the switch trigger so as to control the operation of the switch trigger, the switch controlling rod further comprises an elastic member for causing the switch controlling rod to force the stopping member to restore towards the switch trigger, and the switch controlling rod is more connected with a pushing button protruding out from the housing in a normal state.

According to one embodiment, the stopping member is a convex portion extending from the switch controlling rod towards the switch trigger.

According to one embodiment, the electric circular saw further comprising a rotating button protrudes out from the housing in a normal state, the control member is connected with the rotating button.

According to one embodiment, the electric circular saw further comprises a second connecting rod, the control member defines a groove opening therein and comprises a first flange formed adjacent to the groove opening, the second connecting rod is pivotally mounted to the inner wall of the housing through a pin shaft and having a hook portion for mating with the groove opening at one end and a second flange at the other end, and the second connecting rod is more connected with an elastic member for driving the second connecting rod to rotate towards the control member; wherein in the normal state, the hook portion of the second connecting rod contacts the first flange; when the control member is rotated in the first direction, the hook portion of the second connecting rod is mated with the groove opening; and when the housing and the base plate are pressed oppositely, the depth support presses the second flange and forces the second connecting rod to rotate in a disengaged direction of the hook portion and the groove opening.

As an improvement, the control member is further connected with an elastic member for driving the rotary plate to rotate in a second direction opposite to the first direction.

According to one embodiment, the control member is a rotary plate, and the driving portion is a first convex portion protruding outwards from a side of the rotary plate, and the limiting portion is a second convex portion protruding outwards from the side of the rotary plate in the front of the driving portion in a first direction.

As an improvement, the electric circular saw further comprises a saw blade, the base plate is pivotally connected to the housing and defines a saw gap adapted for the saw blade to pass through, the switch controlling rod comprises a blocking portion which is capable of contacting the depth support, and when a pivoting point between the base plate and the housing is considered as a circle center, the arc angle from the blocking portion to a contact surface of the depth support is smaller than that from the lower end of the saw blade to the saw gap.

As an improvement, the blocking portion is a convex portion extending from the switch controlling rod towards the depth support.

As an improvement, the depth support defines a sliding groove therein, and the first connecting rod is pivotally mounted to the inner wall of the housing through a pin shaft and has a stopping portion which may be accommodated into the sliding groove so as to limit the travel range of the depth support and an elastic member for driving the first connecting rod to rotate in an engaged direction of the stopping portion and the sliding groove.

According to one embodiment, the control member is a rotary plate, and the driving portion is a first arc groove arranged on the rotary plate, and the limiting portion is a second arc groove arranged on the rotary plate, wherein the first connecting rod is mated with the first arc groove by a first pin stop and the switch controlling rod is mated with the second arc groove by a second pin stop.

As an improvement, a first sliding groove and a second sliding groove are continuously opened in the depth support from bottom to top along a longitudinal direction, wherein the first sliding groove has a transverse width smaller than that of the second sliding groove, the first connecting rod being pivotally mounted to the inner wall of the housing through a pin shaft and rotated cooperatively with the switch controlling rod in the same direction, a first boss protruding from the lower end of the first connecting rod towards the depth support and a second boss protruding from the first boss, wherein the second boss has a transverse width which enables it to slide in both the first sliding groove and the second sliding groove of the depth support, and the first boss has a transverse width which only enables it to slide in the second sliding groove of the depth support, the first connecting rod being connected with an elastic member for driving the first connecting rod to rotate in an engaged direction of the first boss and the second sliding groove, and the distance between the two ends of the first arc groove being larger than the length of the first boss and smaller than the total length of the first boss and the second boss.

The electric circular saw of the present invention can limit the travel range of the switch trigger in the normal operation and the operation of exchanging the saw blade, thereby avoiding the safety accident caused by the accidental operation. Moreover, in the normal state, the exposure of the saw blade of the electric circular saw is limited, thereby avoiding the saw blade damaging the workpiece or hurting people in the non-operation state. Additionally, the switch protection mechanism of the electric circular saw takes the form of mechanical linkage, thus it is simple and reliable and can be remained in the limited state even in the accident, thereby effectively avoiding the safety accident when the user is unaware and operates it normally.

DETAILED DESCRIPTION

Figure 1:
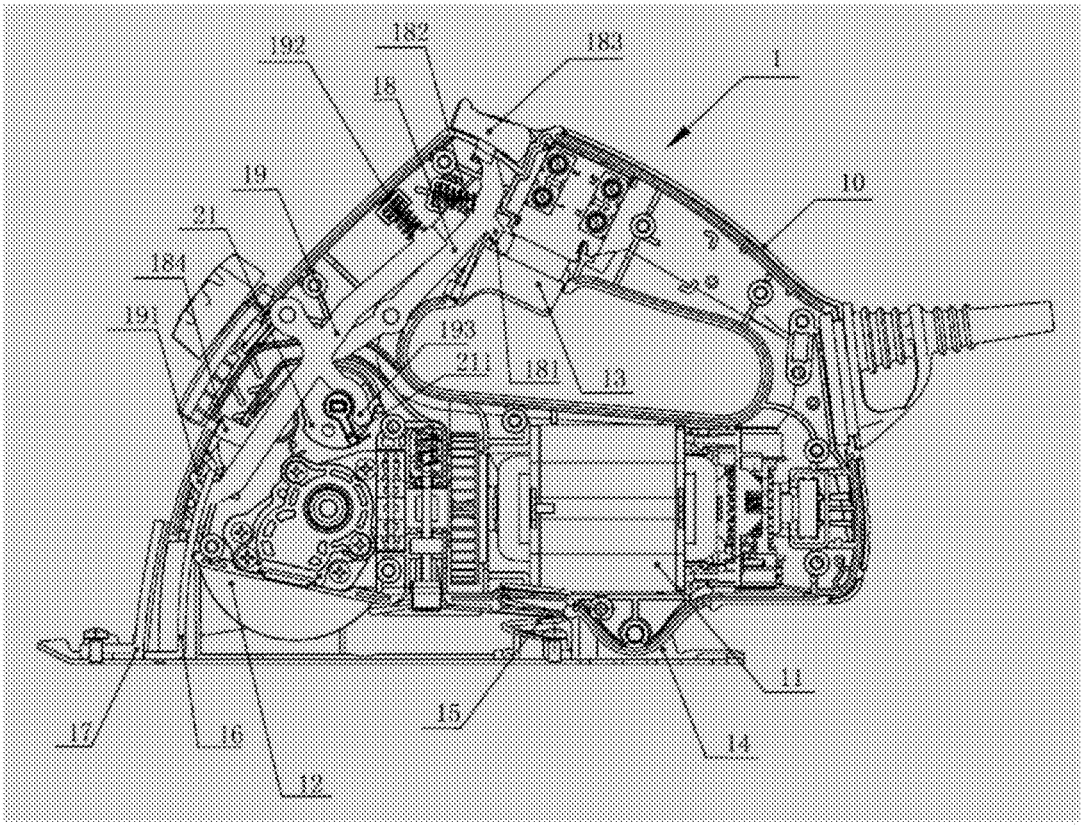
FIG. 1 is a sectional view of an electric circular saw in the normal state.

In order to facilitate the expression, the following words "left", "right", "clockwise" and "anticlockwise" are identical with the directions shown in the drawings.

As shown in FIG. 1, an electric circular saw 1 of the present invention includes a housing 10 with a motor 11 and a saw blade 12 arranged therein. The motor 11 is connected to the saw blade 12 by a gear box (not indicated in the drawings). A switch trigger 13 is arranged on a handle portion of the housing 10 and can turn on the power to start the motor 11. The electric circular saw 1 further includes a base plate 14 rotatably and pivotally connected to the housing 10 through a pin shaft (not indicated in the drawings), and a pressing spring 15 for forcing the housing 10 and the base plate 14 to move away from each other is arranged therebetween. The base plate 14 is provided with a depth support 16 which can slide along a sliding groove (not indicated in the drawings) in the housing 10 and a movable shield 17 for covering the saw blade 12. Additionally, the base plate 14 defines a saw gap (not indicated in the drawings) opened for the saw blade 12 to pass through.

Figure 2:
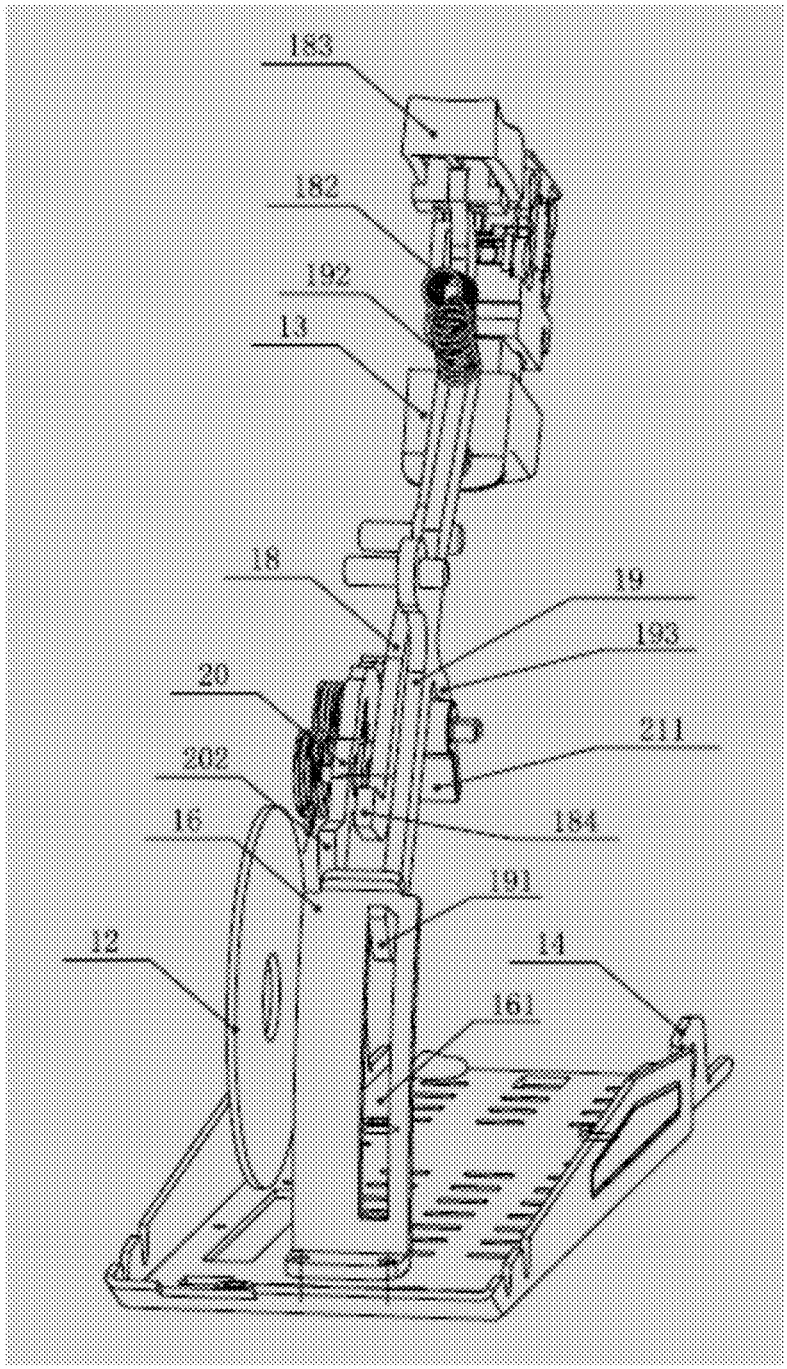
FIG. 2 is a side view illustrating the cooperation of the members of the electric circular saw in the normal state.

As shown in FIGS. 1-2, the electric circular saw 1 also includes a switch controlling rod 18 arranged in the housing 10. The switch controlling rod 18 is pivotally mounted to the inner wall of the housing 10 by a pin shaft (not shown in the drawings), and a stopping member 181 for limiting the travel range of the switch trigger 13 is arranged between the switch controlling rod 18 and the switch trigger 13. The rotation of the switch controlling rod 18 can force the stopping member 181 to get out of the travel range of the switch trigger 13, and then the switch trigger 13 may be controlled to work. Specifically, the switch trigger 13 has a pressing travel towards the handle portion of the housing 10, and the stopping member 181 protrudes out from the switch controlling rod 18 towards the switch trigger 13. The stopping member 181 may be a convex portion which can resist the pressing of the switch trigger 13 so as to limit the turn-on of the electric power. The stopping member 181 may also be embodied in other forms, for example, the stopping member may be a notch arranged on the switch controlling rod 18 and a convex portion extending from the switch trigger 13 towards the switch controlling rod 18, or may be convex portions oppositely extending from the switch controlling rod 18 and the switch trigger 13. The switch controlling rod 18 is further provided with an elastic member 182 for forcing the stopping member 181 to restore towards the switch trigger 13, thus in the normal state, the electric circular saw 1 cannot be started because the stopping member 181 limits the travel range of the switch trigger 13. The elastic member 182 may be embodied in many forms. For example, it is a biasing spring arranged between the inner wall of the housing 10 and the switch controlling rod 18, or a torsion spring arranged at the position of the pin shaft of the switch controlling rod 18. The switch controlling rod 18 is also connected with a pushing button 183 protruding out from the housing 10 in the normal state, thus the operator may push the pushing button 183 so as to rotate the switch controlling rod 18 about the pin shaft and force the stopping member 181 to get out of the travel range of the switch trigger 13. At this moment, the electric circular saw 1 may be started by pushing the switch trigger 13. The switch controlling rod 18 is further provided with a blocking portion 184 which can contact the depth support 16, such as a convex portion extending from the lower end of the switch controlling rod 18 towards the depth support 16. When a pivoting point between the base plate 14 and the housing 10 is considered as a circle center, and the arc angle from the blocking portion 184 to a contact surface between the blocking portion 184 and the depth support 16 is smaller than the arc angle from the lower end of the saw blade 12 to the saw gap. Thus, in the normal state, when the operator puts the base plate 14 on the workpiece and presses the housing 10, the blocking portion 184 of the switch controlling rod 18 may abut against the depth support 16 of the base plate 14 before the saw blade 12 is exposed out from the saw gap, thereby preventing the saw blade 12 damaging the workpiece.

The electric circular saw 1 further includes a first connecting rod 19 arranged in the housing 10. Additionally, the depth support 16 defines a sliding groove 161 therein. The first connecting rod 19 is pivotally mounted to the inner wall of the housing 10 through a pin shaft (not indicated in the drawings) and has a stopping portion 191 at the front end thereof which may be accommodated into the sliding groove 161 so as to limit the travel range of the depth support. For example, the stopping portion 191 is a hook portion extending forwards along the lower end of the first connecting rod 19. The first connecting rod 19 is further connected with an elastic member 192 for driving it to rotate in an engaged direction of the stopping portion 191 and the sliding groove 161. Thus, in the normal state, under the action of the limitation of the limiting portion 191, the depth support 16 slides along the sliding groove in the housing 10 so as to adjust the cutting depth of the saw blade 12. That is, the rotation range of the base plate 14 relative to the housing 10 about the pin shaft is limited by the length range of the sliding groove 161.

Figure 3:
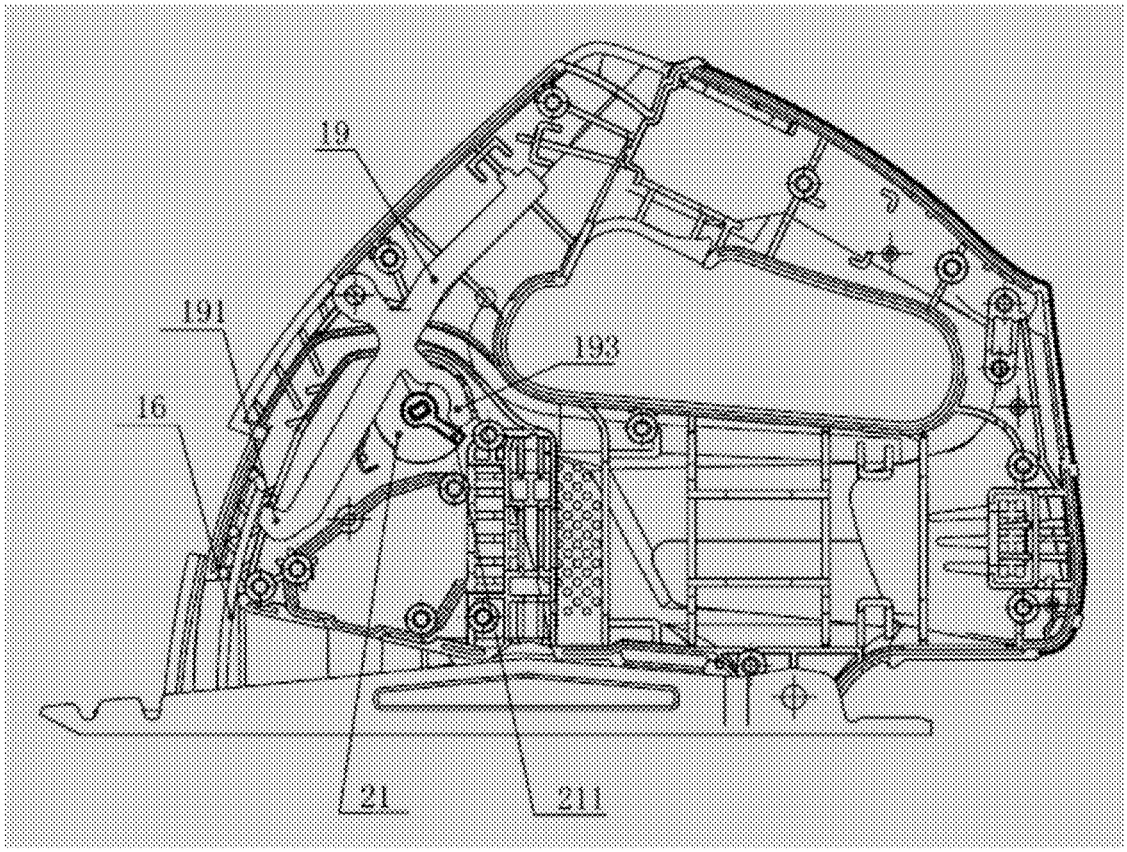
FIG. 3 is a schematic view illustrating the cooperation of the rotary plate and the first connecting rod in the initial stage for opening the base plate.
Figure 4:
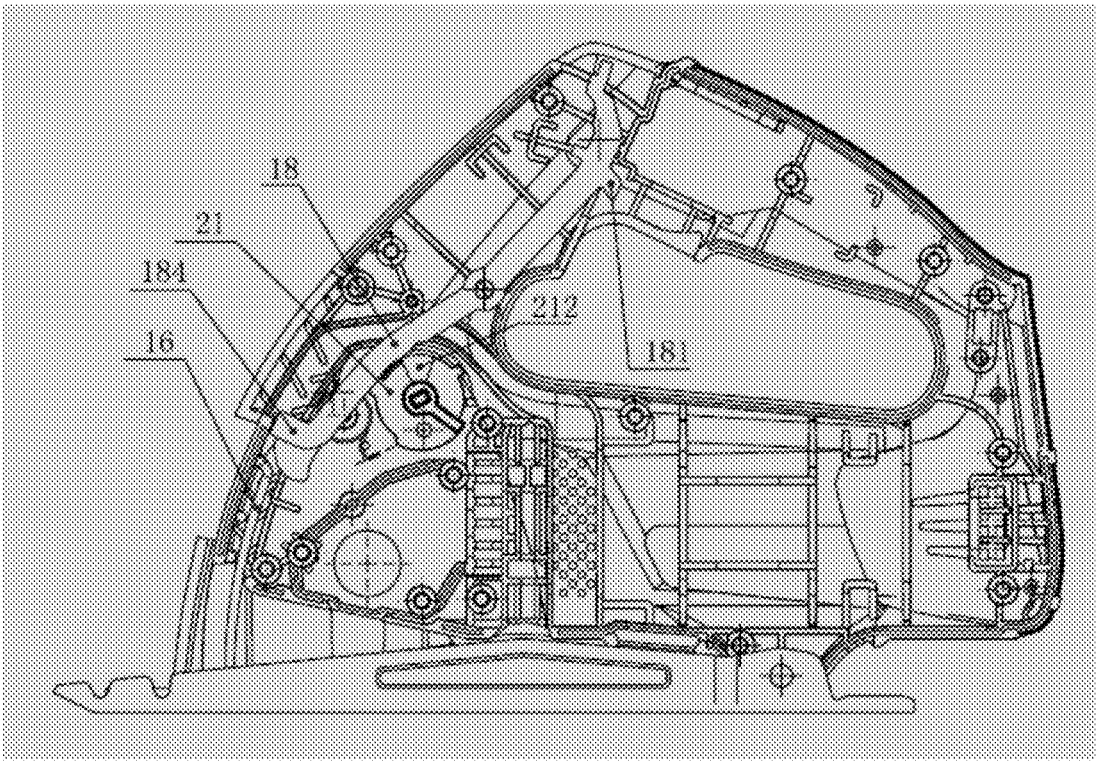
FIG. 4 is a schematic view illustrating the cooperation of the rotary plate and the switch controlling rod in the initial stage for opening the base plate.

Referring to FIGS. 3-4, the electric circular saw 1 further includes a movable control member 21. The movable control member 21 has a driving portion 211 for driving the first connecting rod 19 and a limiting portion 212 for limiting the switch controlling rod 18, and the moving distance from the driving portion 211 to a contact surface between the driving portion 211 and the first connecting rod 19 is larger than or equal to the moving distance from the limiting portion 212 to a contact surface between the limiting portion 212 and the switch controlling rod 18. For example, the control member 21 is a rotary plate which is pivotally mounted to the inner wall of the housing 10 by a pin shaft, the driving portion 211 is a first convex portion protruding outwards from one side of the rotary plate and the limiting portion 212 is a second convex portion protruding outwards from the side of the rotary plate in the front of the driving portion in a first direction. A convex portion 193 extends from the first connecting rod 19 towards the driving portion 211. When the control member 21 is rotated in the first direction (i.e., the anticlockwise direction as shown in the drawings), the driving portion 211 will press the convex portion 193, and causes the first connecting rod 19 to rotate in a disengaged direction of the stopping member 191 and the sliding groove 161. At this moment, the stopping member 191 is disengaged from the sliding groove 161, thus the sliding of the depth support 16 can get away from the limitation of the stopping portion 191, and the base plate 14 may be rotated to a position where the depth support 16 is disengaged from the housing 10 completely, thereby exposing the saw blade 12, and then the operator can exchange the saw blade 12. Since the moving distance from the driving portion 211 to the contact surface between the driving portion 211 and the first connecting rod 19 is larger than or equal to the moving distance from the limiting portion 212 to the contact surface between the limiting portion 212 and the switch controlling rod 18, the limiting portion 212 may press the rod body of the switch controlling rod 18 and limit the rotation of the switch controlling rod 18 in the disengaged direction of the stopping member 181 and the switch trigger 13 when the driving portion 211 presses the convex portion 193. At this moment, the stopping member 181 can limit the travel range of the switch trigger 13, that is to say, when the operator exchanges the saw blade 12, the switch controlling rod 18 cannot be rotated even if the pushing button 183 protruding out from the housing 10 is pushed, thus the switch trigger 13 always cannot be pressed, thereby avoiding the electric circular saw 1 being started accidentally when exchanging the saw blade 12.

Figure 7:
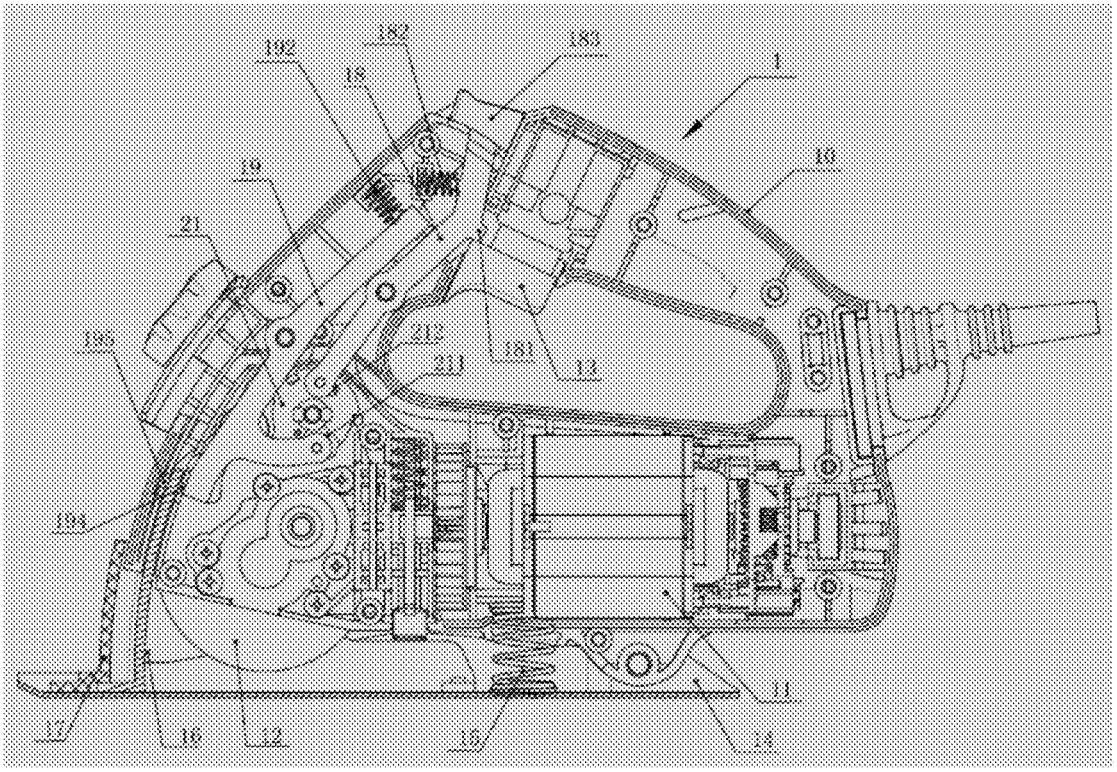
FIG. 7 is a sectional view of an electric circular saw in the normal state which has another type of the rotary plate.
Figure 8:
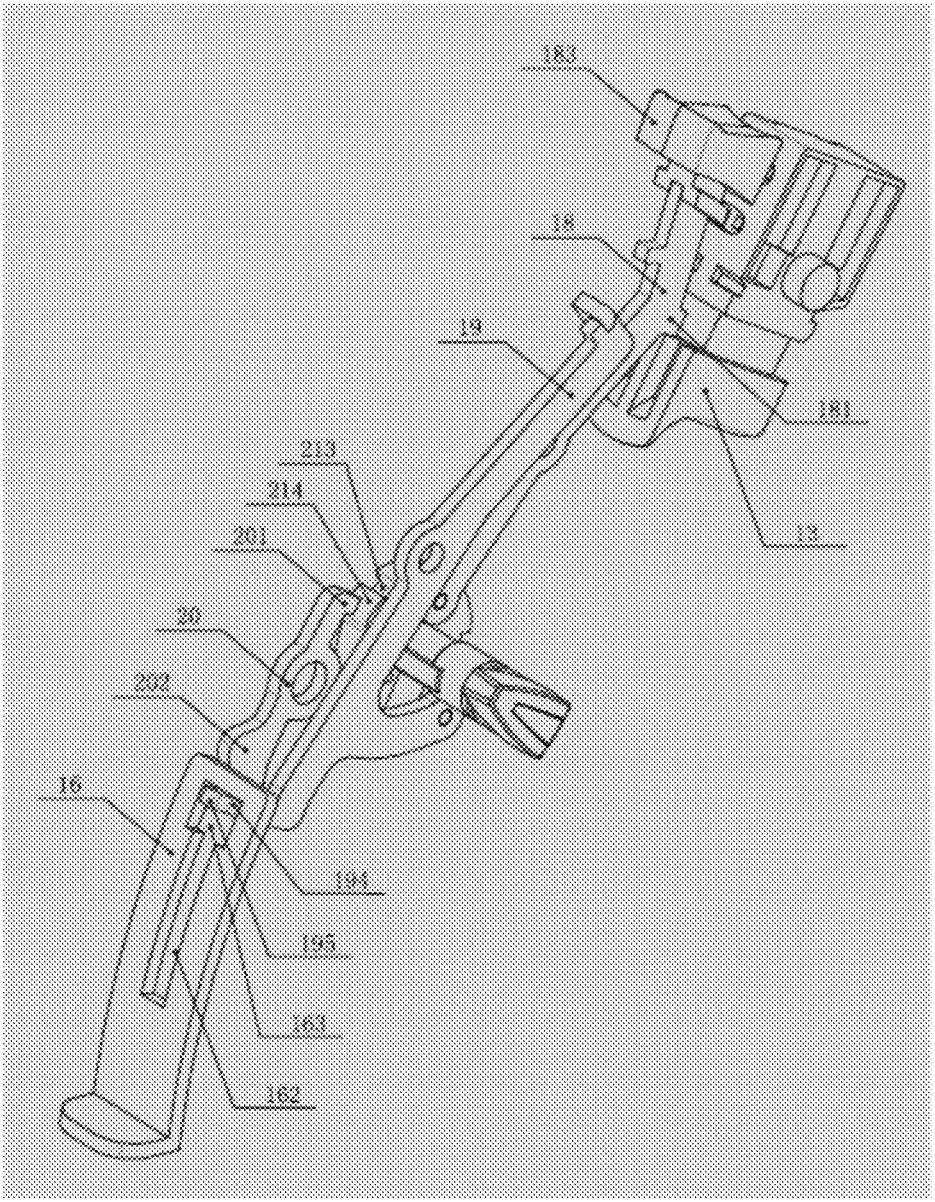
FIG. 8 is a side view illustrating the cooperation of the members of the electric circular saw in the normal state which has another type of the rotary plate.
Figure 9:
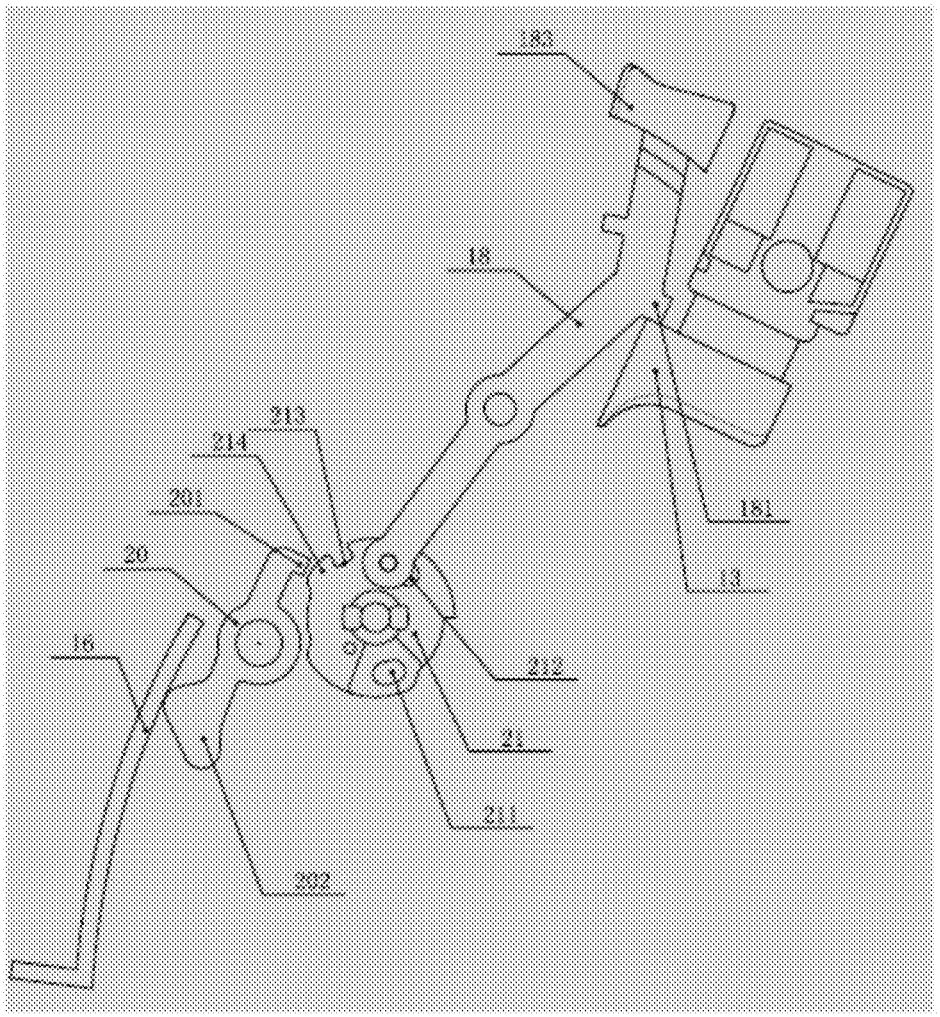
FIG. 9 is a schematic view illustrating the cooperation of the members of another type of the rotary plate.

FIGS. 7 and 9 show another embodiment of the control member 12 in the form of the rotary plate. Specifically, the driving portion 211 is a first arc groove arranged on the rotary plate and the limiting portion 212 is a second arc groove arranged on the rotary plate. The first connecting rod 19 is mated with the first arc groove by a first pin stop (not indicated in the drawings) and the switch controlling rod 18 is mated with the second arc groove by a second pin stop (not indicated in the drawings). As a corresponding modification, the switch controlling rod 18 does not have the above mentioned blocking portion 184. A first sliding groove 162 and a second sliding groove 163 are continuously opened on the depth support 16 from bottom to top along a longitudinal direction, wherein the first sliding groove 162 has a transverse width smaller than that of the second sliding groove 163. The first connecting rod 19 does not have the above mentioned stopping portion 191 and the convex portion 193. As an alternative way, a first boss 194 protrudes from the lower end of the first connecting rod 19 towards the depth support 16 and a second boss 195 protrudes from the first boss 194. The second boss 195 has a transverse width smaller than that of the first boss 194, thus the second boss 195 can slide in both the first sliding groove 162 and the second sliding groove 163 of the depth support 16, and the first boss 194 can only slide in the second sliding groove 163 of the depth support 16. That is to say, the upper boundary (not indicated in the drawings) and the lower boundary (not indicated in the drawings) of the second sliding groove 163 limit the sliding range of the first boss 194, and the upper boundary of the second sliding groove 163 and the lower boundary (not indicated in the drawings) of the first sliding groove 162 limit the sliding range of the second boss 195. Referring to FIG. 8, with this configuration, in the normal state, the first boss 194 of the first connecting rod 19 is limited in the second sliding groove 163 under the action of the elastic member 192, thus, when the housing 10 and the base plate 14 are pressed oppositely, the saw blade 12 still cannot protrude out from the saw gap of the base plate 14, thereby avoiding the damage to the workpiece due to the exposure of the saw blade 12 in the non-operation state. The first connecting rod 19 also cooperates with the rod body of the switch controlling rod 18 to form a linkage through a hook (not indicated in the drawings) extending laterally. With this configuration, when it needs to work, the pushing button 183 is pushed to rotate the switch controlling rod 18, and the moving distance of the first connecting rod 19 which is moved cooperatively with the switch controlling rod 18 can only cause the first boss 194 to disengage from the second sliding groove 164 of the depth support 16, while the second boss 195 is still in the range defined by the first sliding groove 162 and the second sliding groove 163 of the depth support 16, and the base plate 14 can move upwards and downwards under the action of the limitation of the second boss 195. That is to say, the distance between the two ends of the driving portion 211 of the first arc groove is larger than the length of the first boss 194 and smaller than the total length of the first boss 194 and the second boss 195. Additionally, when the operator needs to exchange the saw blade, the control member 21 is rotated in the first direction, and the driving portion 211 of the first arc groove forces the first connecting rod 19 to rotate in the disengaged direction of the second boss 195 and the second sliding groove 163 through the first pin stop, so that the depth support 16 gets away from the limitation of the first connecting rod 19. At this moment, the base plate 14 may be rotated to a position in which the depth support 16 is completely disengaged from the housing 10 so as to expose the saw blade 12. Since the moving distance from the driving portion 211 to the contact surface between the driving portion 211 and the first connecting rod 19 is larger than or equal to the moving distance from the limiting portion 212 and the contact surface between the limiting portion 212 and the switch controlling rod 18, the limiting portion 212 of the second arc groove abuts against the switch controlling rod 18 through the second pin stop and limits the rotation of the switch controlling rod 18 in the disengaged direction of the stopping member 181 and the switch trigger 13, when the driving portion 211 of the first arc groove acts on the first connecting rod 19. At this moment, the stopping member 181 still limits the travel range of the switch trigger 13, thus the switch controlling rod 18 cannot be rotated even if the pushing button 183 protruding out from the housing 10 is pushed. Thus, it can avoid the electric circular saw 1 from being started accidentally when exchanging the saw blade 12.

Additionally, the person skilled in the art can appreciate that there are various replacement structures for the control member 21. For example, the control member 21 may also be a stirring piece (not indicated in the drawings) which can slide along the groove in the inner wall of the housing 10. The driving portion 211 is a rib portion extending outwards from one side of the stirring piece and the limiting portion 212 is a second rib portion extending outwards from the side of the stirring piece. The stirring piece is linked with other members based on the same principle, thus it is unnecessary to go into details here.

Figure 5:
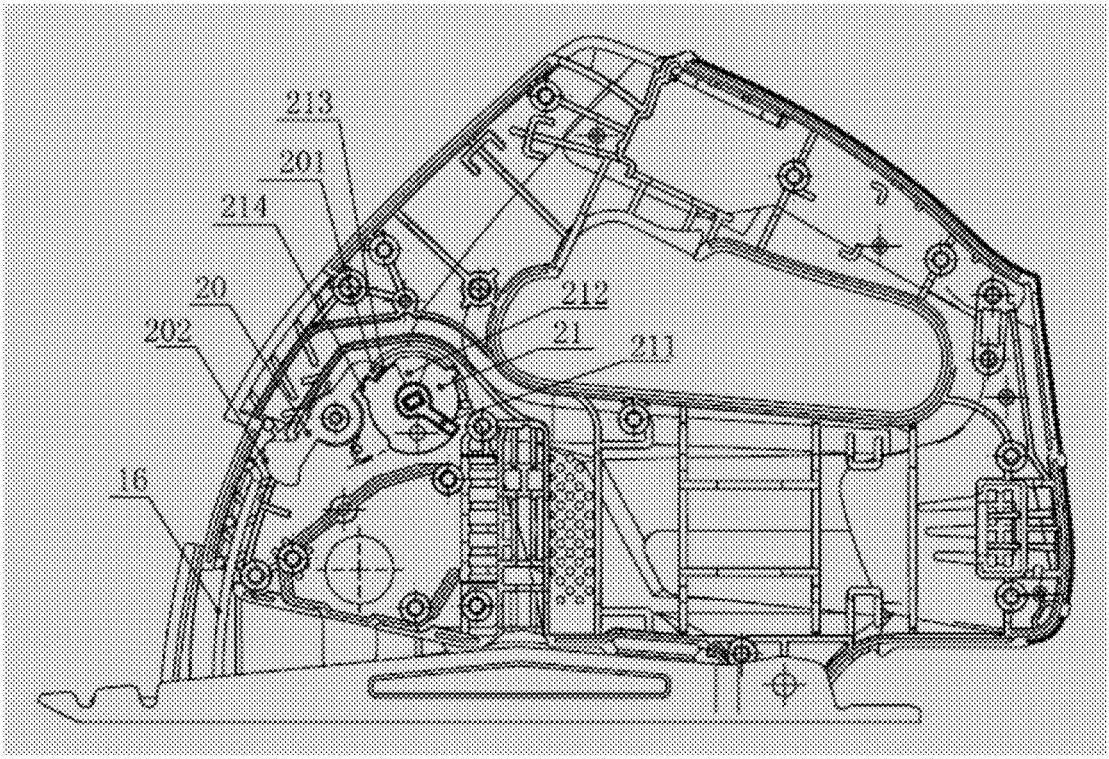
FIG. 5 is a schematic view illustrating the cooperation of the rotary plate and the second connecting rod in the initial stage for opening the base plate.
Figure 6:
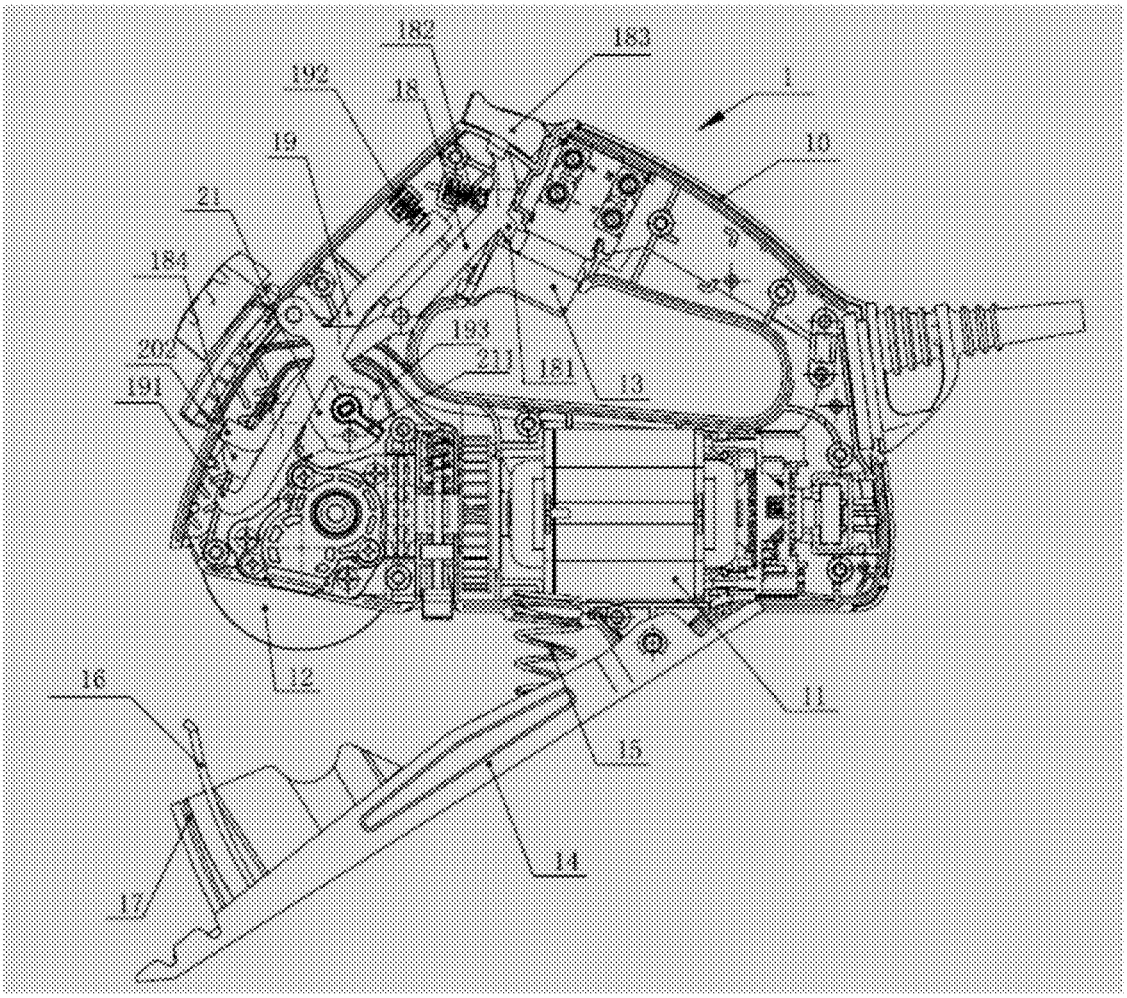
FIG. 6 is a sectional view showing the exchanging of the saw blade of the electric circular saw.

Referring to FIGS. 5 and 9, the control member 21 defines a groove opening 213 at one edge and comprises a first flange 214 formed adjacent to the groove opening 213. The second connecting rod 20 is pivotally mounted to the inner wall of the housing through a pin shaft (not indicated in the drawings) and has a hook portion 201 for mating with the groove opening 213 at one end and a second flange 202 at the other end. The second connecting rod 20 is further connected with an elastic member 203 for driving the second connecting rod 20 to rotate towards the control member 21. The elastic member 203 may be embodied in various forms, for example, it is a biasing spring arranged between the inner wall of the housing 10 and the second connecting rod 20, or a torsion spring arranged at the position of the pin shaft of the second connecting rod 20. In the normal state, the second connecting rod 20 tends to rotate towards the control member 21 under the action of the elastic member 203 and the hook portion 201 thereof contacts the first flange 214 of the control member 21. Since the resisting of the first flange 214 causes the second flange 202 on the other end of the second connecting rod 20 to depart from the depth support 16, it may avoid the sliding of the depth support 16 in the housing 10 being interfered by the second connecting rod 20. When the control member is rotated in the first direction, i.e., in the anticlockwise direction shown in the drawings, the hook portion 201 of the second connecting rod 20 mates with the groove opening 213 along the edge of the control member 21. At this moment, the switch controlling rod 18 forces the stopping member 181 to limit the travel range of the switch trigger 13, the stopping portion 191 of the first connecting rod 19 disengages from the sliding groove 161 of the depth support 16, and the control member 21 is fixed by the second connecting rod 20, thus the hands of the operator are released so as to exchange the saw blade 12. Due to the engagement, the second connecting rod 20 is rotated towards the control member 21 for a certain distance so that the second flange 202 on the other end moves to the sliding path of the depth support 16. Referring to FIG. 6, when the saw blade 12 is exchanged, the operator presses the housing 10 and the base plate 14 oppositely, the depth support 16 extends into the housing 10 and contacts the second flange 202 of the second connecting rod 20, and forces the second connecting rod 20 to rotate in the disengaged direction of the hook portion 201 and the groove opening 213, and then the electric circular saw 1 can be restored to the normal state by rotating the control member 21 in a second direction opposite to the first direction. Additionally, the control member 21 is also connected with an elastic member 215 such as a torsion spring for forcing it to rotate in the second direction opposite to the first direction, thus, when the operator presses the housing 10 and the base plate 14 in the opposite directions, under the action of the biasing of the elastic member 215, the control member 21 is automatically restored to the normal position, i.e., the position that the first flange 214 of the control member 21 faces the hook portion 201 of the second connecting rod 20, thus the operation of the operator is simplified. Additionally, the electric circular saw comprises a rotating button which protrudes out from the housing in a normal state, the control member 21 is connected with the rotating button. It helps the operator to control the rotation of the control member 21 by the rotating button.

The safety protection of the electric circular saw 1 of the present invention is explained as follows: in the normal state, due to the action of the limiting member 181 of the switch controlling rod 18, the switch trigger 13 cannot be pressed to start the motor 11, thereby achieving the self-locking function of the switch. Moreover, in the normal state, the electric circular saw 1 also has a function of enclosing the saw blade, that is to say, the saw blade 1 cannot be exposed even though the housing 10 and the base plate 14 are pressed in the opposite directions. When it needs to work, the pushing button 183 is pushed to unlock firstly, the switch trigger 13 is further pushed to start the motor 11, and then the housing 11 can be pressed to cause the saw blade 12 to protrude out from the saw gap on the base plate 14 so as to perform a cutting. After cutting, the pressing on the housing 11 is released or the electric circular saw 1 is lifted, thus the saw blade 12 disengages from the saw gap on the base plate 14 under the action of the biasing of the pressing spring 15, at this time, the pushing button 183 is released and the switch controlling rod 18 can be restored to achieve the self-locking of the switch. If the operator needs to exchange the saw blade 12, the control member 21 may be rotated in the first direction through the rotating button to the position where the hook portion 201 of the second connecting rod 20 is engaged with the groove opening 213 of the control member 21, and then the base plate 14 can disengage from the housing 10 so as to exchange the saw blade 12. At this moment, the limiting member 181 of the switch controlling rod 18 always limits the travel range of the switch trigger 13 and it cannot be unlocked by the pushing button 183, thereby avoiding the risk due to the start-up of the motor 11 when exchanging the saw blade 12. After the saw blade 12 is exchanged, the operator can make the electric circular saw 1 to be restored to the normal state only by pressing the housing 10 and the base plate 14 opposite to each other.

10: housing;
11: motor;
12: saw blade;
13: switch trigger;
14: base plate;
15: pressing spring;
16: depth support;
17: movable shield;
18: switch controlling rod;
19: the first connecting rod;
20: the second connecting rod;
21: control member.

The above embodiments only explain the concept and principle of the present invention, but not limit the present invention. The person skilled in the art may appreciate that various replacements and modifications may be made to the present invention besides the above preferable embodiments, which are contained in the scope of the present invention. The protection scope of the present invention may be determined by the attached claims.

We claim:

1. An electric circular saw, comprising
a housing;
a switch trigger arranged on the housing;
a switch controlling rod for limiting the travel range of the switch trigger, wherein the switch controlling rod is pivotally mounted to the inner wall of the housing through a pin shaft, a stopping member for limiting the travel range of the switch trigger is arranged between the switch controlling rod and the switch trigger, and the rotation of the switch controlling rod forces the stopping member to get out of the travel range of the switch trigger so as to control the operation of the switch trigger, the switch controlling rod further comprises an elastic member for causing the switch controlling rod to force the stopping member to restore towards the switch trigger, and the switch controlling rod is more connected with a pushing button protruding out from the housing in a normal state;
a base plate;
a depth support arranged on the base plate;
a first connecting rod for limiting the travel range of the depth support;
a rotary plate arranged in the housing, the rotary plate comprising a first convex portion protruding outwards from a side of the rotary plate for driving the first connecting rod, and a second convex portion protruding outwards from the side of the rotary plate in the front of the first convex portion in a first direction for limiting the switch controlling rod, and the moving distance between the first convex portion and the first connecting rod being larger than or equal to that between the second portion and the switch controlling rod.

2. The electric circular saw according to claim 1, wherein the electric circular saw further comprising a rotating button which protrudes out from the housing in a normal state, the rotary plate is connected with the rotating button.

3. The electric circular saw according to claim 1, wherein the stopping member is a convex portion extending from the switch controlling rod towards the switch trigger.

4. The electric circular saw according to claim 1, wherein the electric circular saw further comprises a saw blade, the base plate is pivotally connected to the housing and defines a saw gap adapted for the saw blade to pass through, the switch controlling rod comprises a blocking portion which is capable of contacting the depth support, and when a pivoting point between the base plate and the housing is considered as a circle center, the arc angle from the blocking portion to a contact surface of the depth support is smaller than that from the lower end of the saw blade to the saw gap.

5. The electric circular saw according to claim 4, wherein the blocking portion is a convex portion extending from the switch controlling rod towards the depth support.

6. The electric circular saw according to claim 1, wherein the depth support defines a sliding groove therein, and the first connecting rod is pivotally mounted to the inner wall of the housing through a pin shaft and has a stopping portion which may be accommodated into the sliding groove so as to limit the travel range of the depth support and an elastic member for driving the first connecting rod to rotate in an engaged direction of the stopping portion and the sliding groove.

7. The electric circular saw according to claim 1, wherein the electric circular saw further comprises a second connecting rod, the rotary plate defines a groove opening therein and comprises a first flange formed adjacent to the groove opening, the second connecting rod is pivotally mounted to the inner wall of the housing through a pin shaft and having a hook portion for mating with the groove opening at one end and a second flange at the other end, and the second connecting rod is more connected with an elastic member for driving the second connecting rod to rotate towards the rotary plate;

wherein in the normal state, the hook portion of the second connecting rod contacts the first flange;

when the rotary plate is rotated in the first direction, the hook portion of the second connecting rod is mated with the groove opening; and when the housing and the base plate are pressed oppositely, the depth support presses the second flange and forces the second connecting rod to rotate in a disengaged direction of the hook portion and the groove opening.

8. The electric circular saw according to claim 7, wherein the rotary plate is further connected with an elastic member for driving the rotary plate to rotate in a second direction opposite to the first direction.

9. An electric circular saw, comprising a housing;

a switch trigger arranged on the housing;

a switch controlling rod for limiting the travel range of the switch trigger;

a base plate;

a depth support arranged on the base plate;

a first connecting rod for limiting the travel range of the depth support; and an operational control member arranged in the housing, and the operational control member comprising a driving portion for driving the first connecting rod and a limiting portion for limiting the switch controlling rod, and the moving distance between the driving portion and the first connecting rod being larger than or equal to that between the limiting portion and the switch controlling rod.

10. The electric circular saw according to claim 9, wherein the switch controlling rod is pivotally mounted to the inner wall of the housing through a pin shaft, a stopping member for limiting the travel range of the switch trigger is arranged between the switch controlling rod and the switch trigger, and the rotation of the switch controlling rod forces the stopping member to get out of the travel range of the switch trigger so as to control the operation of the switch trigger, the switch controlling rod further comprises an elastic member for causing the switch controlling rod to force the stopping member to restore towards the switch trigger, and the switch controlling rod is more connected with a pushing button protruding out from the housing in a normal state.

11. The electric circular saw according to claim 10, wherein the stopping member is a convex portion extending from the switch controlling rod towards the switch trigger.

12. The electric circular saw according to claim 9, wherein the electric circular saw further comprising a rotating button which protrudes out from the housing in a normal state, the control member is connected with the rotating button.

13. The electric circular saw according to claim 9, wherein the electric circular saw further comprises a second connecting rod, the control member defines a groove opening therein and comprises a first flange formed adjacent to the groove opening, the second connecting rod is pivotally mounted to the inner wall of the housing through a pin shaft and having a hook portion for mating with the groove opening at one end and a second flange at the other end, and the second connecting rod is more connected with an elastic member for driving the second connecting rod to rotate towards the control member;

wherein in the normal state, the hook portion of the second connecting rod contacts the first flange;

when the control member is rotated in the first direction, the hook portion of the second connecting rod is mated with the groove opening; and when the housing and the base plate are pressed oppositely, the depth support presses the second flange and forces the second connecting rod to rotate in a disengaged direction of the hook portion and the groove opening.

14. The electric circular saw according to claim 13, wherein the control member is further connected with an elastic member for driving the rotary plate to rotate in a second direction opposite to the first direction.

15. The electric circular saw according to claim 9, wherein the control member is a rotary plate, and the driving portion is a first convex portion protruding outwards from a side of the rotary plate, and the limiting portion is a second convex portion protruding outwards from the side of the rotary plate in the front of the driving portion in a first direction.

16. The electric circular saw according to claim 15, wherein the electric circular saw further comprises a saw blade, the base plate is pivotally connected to the housing and defines a saw gap adapted for the saw blade to pass through, the switch controlling rod comprises a blocking portion which is capable of contacting the depth support, and when a pivoting point between the base plate and the housing is considered as a circle center, the arc angle from the blocking portion to a contact surface of the depth support is smaller than that from the lower end of the saw blade to the saw gap.

17. The electric circular saw according to claim 16, wherein the blocking portion is a convex portion extending from the switch controlling rod towards the depth support.

18. The electric circular saw according to claim 15, wherein the depth support defines a sliding groove therein, and the first connecting rod is pivotally mounted to the inner wall of the housing through a pin shaft and has a stopping portion which may be accommodated into the sliding groove so as to limit the travel range of the depth support and an elastic member for driving the first connecting rod to rotate in an engaged direction of the stopping portion and the sliding groove.

19. The electric circular saw according to claim 9, wherein the control member is a rotary plate, and the driving portion is a first arc groove arranged on the rotary plate, and the limiting portion is a second arc groove arranged on the rotary plate, wherein the first connecting rod is mated with the first arc groove by a first pin stop and the switch controlling rod is mated with the second arc groove by a second pin stop.

20. The electric circular saw according to claim 16, wherein a first sliding groove and a second sliding groove are continuously opened in the depth support from bottom to top along a longitudinal direction, wherein the first sliding groove has a transverse width smaller than that of the second sliding groove, the first connecting rod being pivotally mounted to the inner wall of the housing through a pin shaft and rotated cooperatively with the switch controlling rod in the same direction, a first boss protruding from the lower end of the first connecting rod towards the depth support and a second boss protruding from the first boss, wherein the second boss has a transverse width which enables it to slide in both the first sliding groove and the second sliding groove of the depth support, and the first boss has a transverse width which only enables it to slide in the second sliding groove of the depth support, the first connecting rod being connected with an elastic member for driving the first connecting rod to rotate in an engaged direction of the first boss and the second sliding groove, and the distance between the two ends of the first arc groove being larger than the length of the first boss and smaller than the total length of the first boss and the second boss.

* * * * *